United States Patent [19]

Makabe et al.

[11] Patent Number: 4,598,657

[45] Date of Patent: Jul. 8, 1986

[54] NEEDLE POSITION INDICATING DEVICE FOR A SEWING MACHINE

[75] Inventors: Hachiro Makabe, Kanagawa; Akio Koide, Tokyo; Chijyo Tachibana, Tokyo; Kazuji Yamamoto, Tokyo, all of Japan

[73] Assignee: Janome Sewing Machine Co. Ltd., Tokyo, Japan

[21] Appl. No.: 782,146

[22] Filed: Sep. 30, 1985

Related U.S. Application Data

[63] Continuation of Ser. No. 411,135, Aug. 24, 1982, abandoned.

[30] Foreign Application Priority Data

Aug. 27, 1981 [JP] Japan ..... 56-125946
Aug. 27, 1981 [JP] Japan ..... 56-125947
Aug. 27, 1981 [JP] Japan ..... 56-125948

[51] Int. Cl.[4] ..... D05B 69/24
[52] U.S. Cl. ..... 112/275
[58] Field of Search ..... 112/444, 275, 277

[56] References Cited

U.S. PATENT DOCUMENTS 3,195,488 7/1965 Winberg ..... 112/275
3,503,352 3/1970 Peterson ..... 112/275
3,564,376 2/1971 Mais et al. ..... 112/275 X
4,013,933 3/1977 Dohi et al. ..... 112/275 X
4,078,506 3/1978 Sasaki ..... 112/277 X
4,406,238 9/1983 Hisatake et al. ..... 112/277

FOREIGN PATENT DOCUMENTS 3019813 11/1980 Fed. Rep. of Germany ..... 112/277
696346 10/1965 Italy ..... 112/275

*Primary Examiner*—Wm. Carter Reynolds
*Attorney, Agent, or Firm*—Michael J. Striker

[57] ABSTRACT

When a sewing machine is stopped, it is electrically indicated whether a needle is positioned at a range where the thread passing is available so that intermittent indication during stitching operation is not made. The sewing machine is provided with a device including a neon lamp and a light interrupting member. The sewing machine has on its exposed front surface lighting indicators which are illuminated by the light of the neon lamp if this light is transmitted by the interrupting member which is mounted on or in the vicinity of the movable device for vertical movement of the needle so that the indicators indicate in the inoperative position of the sewing machine that the thread may be passed in a thread passing device.

3 Claims, 13 Drawing Figures

NEEDLE POSITION INDICATING DEVICE FOR A SEWING MACHINE

This application is a continuation of application Ser. No. 411,135, filed Aug. 24, 1982, now abandoned.

BACKGROUND OF THE INVENTION

The present invention relates to a needle position indicating device.

When an operation is carried out in the sewing machine, to confirm an upper or a lower phase of the needle while the sewing machine is stopped, for example when a thread is passed through a needle eye, an operator should observe the needle to make certain that the needle is positioned within an available range.

In the sewing machine of the type under consideration, when a feed dial is rotated by an operator to select an ordinary feed stitch, and the dial is further rotated to a desired position, a required stitching condition may be provided. On the other hand, if a super stitching is selected, a pattern shape is also selected in addition to a pattern made by combining with the ordinary feed stitch, in combination with the designation of a pattern and the needle amplitude. Therefore, the designation of the patterns for the ordinary feed stitch or the super stitch is made by the rotation of the dial and the above combination is defined by checking marks on an indicating part of the sewing machine. However, it is difficult for an operator to recognize the distinction between the ordinary feed stitch and the super stitch at the first glance.

SUMMARY OF THE INVENTION

It is an object of the present invention to provide an improved needle position indicating device for a sewing machine.

This and other objects of the invention are attained by a needle position indicating device for a sewing machine having an upper drive shaft rotated to vertically reciprocate a needle bar having a needle attached to the lower end thereof, an electric motor operatively connected to the upper drive shaft to rotate the latter, and an electric circuit including at least a power supply and a manually operated controller operated in one way to connect said motor to said power supply to energize the former and operated in another way to disconnect said motor from said power supply to deenergize the former, the needle position indicating device comprising indicating means electrically connected to said electric circuit, said indicating means being disconnected from said power supply and being prevented from emitting light when said controller is operated in said one way to connect said motor to said power supply, said indicating means being free to emit light with a supply of a sufficient voltage from said power supply when said controller is operated in said another way to disconnect said motor from said power supply; and shield means operated in association with said upper drive shaft so as to expose said indicating means at a predetermined angular position of said upper drive shaft corresponding to a predetermined position of the needle when said motor is disconnected from said power supply.

The present invention provides an electric light source comprising a discharge tube located in the vicinity of a movable portion for vertically moving the needle, a light interruption member for the movable portion, operative for passing or interrupting light from the light source so that the passing condition indicates required upper and lower phases of the needle, whereas during the driving of the sewing machine, both terminals of the light source are disconnected from the indicating means by a controller, and the light source is OFF, thereby the indication is made only when the sewing machine is stopped.

The indicating light source may be provided in the vicinity of the feed dial, and photo-conductors may be provided over a plurality of determined indicating positions apart from the light source. A light interrupting plate may be placed between a side end of the photo-conductors and the light source in correspondence to each of the indicating positions for receiving or interrupting light from the source. The light interrupting plate may be mechanically associated with the movement of the feed dial to define a plurality of indicating positions for distinguishing and indicating one or a plurality of super feed stitchings or ordinary feed stitches. By interrupting the light and indicating the selected feed, the machine operator may exactly distinguish the stitch.

BRIEF DESCRIPTION OF THE DRAWINGS

FIGS. 3 through 8 illustrate a first embodiment of the needle position indicating device, of which FIGS. 3, 5 and 8 are examples of 1st, 2nd and 3rd control of which circuits of the machine motor according to the invention, FIG. 4 is a perspective view of an indicator of the invention, FIG. 6 is a side view of an upper portion of the sewing machine with a modified indicator, and FIG. 7 is a front view of a light interrupting member in FIG. 6, FIGS. 9 through 13 illustrate another embodiment of the needle position indicating device, of which

DETAILED DESCRIPTION OF THE PREFERRED EMBODIMENTS

Figure 1:
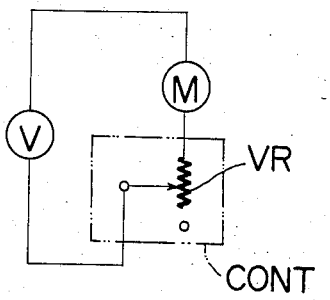
FIG 1 PRIOR ART
FIGS. 1 and 2 show conventional speed control circuits of the sewing machine motor.

The invention will be explained in reference to the attached drawings. FIG. 1 is the most simple speed control circuit of the machine motor. In the same, the machine motor M is connected in series to a variable resistor VR of a step controller CONT, which is speed-controlled by a voltage which is effected with resistance control of a commercial AC power source.

Figure 2:
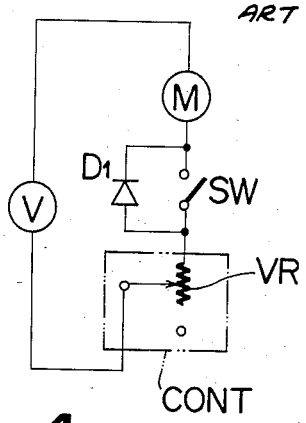
FIG 2 PRIOR ART

As shown in FIG. 2, a diode D1 is connected in series for switching to operation or inoperation by a high-low speed switch SW in order to operate the low speed control drive by resistance control of half-wave and the high speed control drive by AC resistance control.

Figure 3:
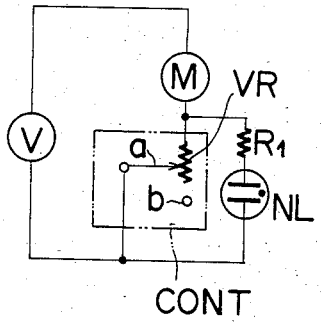

FIG. 3 shows the 1st embodiment of the invention, in which a neon lamp NL which is a discharging tube serving as a light source, is connected in series to an electric current limiting resistor R1 which is extremely larger in comparison with impedance of the machine motor M, and those are connected in parallel with the step controller CONT such as shown in FIG. 1. A movable contact (a) of the controller is, at an inoperative position, positioned on a dummy contact (b) and opens the motor M, and when it is operated it contacts a variable resistor VR, and increases or decreases the variable resistor by its operating amount. With respect to the neon lamp NL, for example, the voltage of starting the discharge and the voltage of maintaining discharge are about 85 V and 60 V, respectively for the circuit where the AC voltage of the electric source V is 100 V, and when the contact (a) is on the resistor VR the voltage between both terminals of the resistor VR, i.e., the voltage falling of the resistor VR is below said voltage of starting the discharge so that the neon lamp NR does not light.

Figure 4:
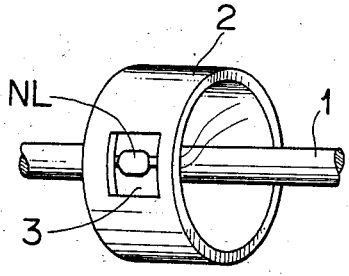

FIG. 4 shows an indicating system where an upper shaft 1 of the sewing machine is formed with a substantially cylindrical, cup like interrupting member 2 which is formed with a window 3, and the neon lamp NL is fixed at an intermediate portion between the rotating path of the window and the upper shaft 1. A front part in FIG. 4 corresponds to an indicating part of the sewing machine (not shown) which is illuminated by the light passing through the window 3.

Figure 5:
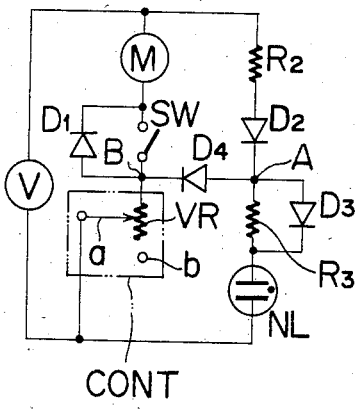

FIG. 5 shows the 2nd embodiment of the invention, in which the neon lamp NL is provided in the conventional circuit of FIG. 2. The power source V is connected in series with a diode D2 and a current limiting resistor R2 for checking the current flowing in opposition to the diode D1, and is connected in series with a circuit connected in parallel with a diode D3 and a current limiting resistor R3, and the neon lamp NL is connected via each of these circuits. The connection A of the series circuits and the connection B between the controller CONT and the diode D1 are connected via a diode D4 to form a circuit via the diodes D4 and D1 and a circuit via the diodes D2 and D4. Resistance values of the resistors R2 and R3 are equal to each other and extremely larger than the resistance values of the variable resistor VR and the impedance of the motor M.

Figure 6:
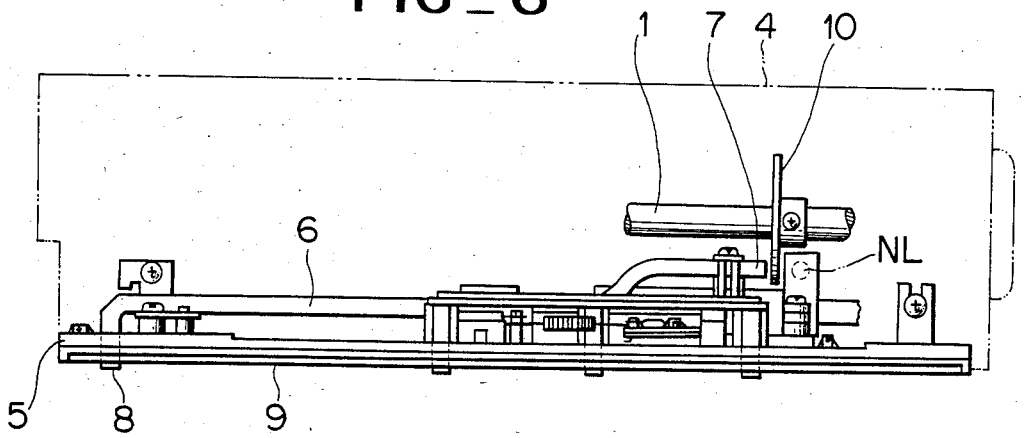

FIG. 6 shows the other embodiment of the indicating system in which the neon lamp NL is fixed to a decorated plate frame 5 at the front of the machine body 4. The photo-conductor 6 is moulded of, e.g., methacrylate resin, and one side end thereof, which is a light-receiving end or the light source 7, is positioned at the light receiving position opposite to the neon lamp NL and the other end 8 of the photoconductor is transmitted with the light. The end 8 is exposed through the decorated plate 9 at the front of the sewing machine and serves as an indicating portion for the transmitted light. The main shaft 1 is fixed with the interrupting member 10 between the neon lamp NL and the photoconductor 6. The interrupting member 10 is formed in a disc and with a notch 11 seen in FIG. 7, which faces the side end of the light receiving end 7, and when the needle has a determined upper or lower phase and the photoconductor is ready for receiving the light, the notch 11 transmits the light of the neon lamp NL to the indication portion 8 to make it luminous.

Figure 7:
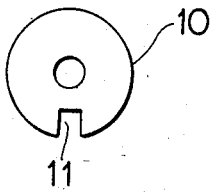

A next reference will be made to a combination of the control circuit shown in FIG. 5 and the indicating system shown in FIGS. 6 and 7. When the step controller CONT and the sewing machine is stopped, the movable contact (a) of the controller is on the dummy contact (b) and the electric current passing through the controller CONT does not flow in the machine motor M. The neon lamp NL is of one directional electric current to the alternating voltage of AC power source V, and the exposed indication portion is lighted by passing AC current via the resistor R2 and the diodes D2 and D3, and, as the other directional electric current occurs, via the resistor R3, the diodes D4 and D1 or the switch SW, and the machine motor M. When the notch 11 faces the neon lamp NL at stopping of the sewing machine, the light receiving end 7 of the photoconductor 6 receives the light and transmits the light to indicate that the stopping position is at the range where the thread may be passed in the thread passing device.

Subsequently, when the controller CONT is operated, the movable contact (a) contacts the variable resistor VR, and the motor M is speed-controlled by the operating amount due to the position of the contact (a). When the high-low speed switches SW is closed, the maximum rotation is at high speed, and when it is opened, the maximum rotation is half wave-controlled. The voltage falling in the variable resistor VR is below the voltage of starting the discharge of the neon lamp NL not only with respect to the electric current passing through the resistor R2 and the diodes D2, D4 but also with respect to the electric current passing through the diode D1 and the motor M, and does not start the discharge, whereby the lighting indication is not made during rotation of the sewing machine.

Figure 8:
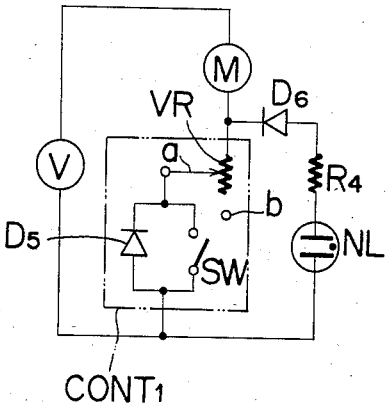

FIG. 8 shows the 3rd embodiment of the invention which is used if a controller CONT[1] is provided with a diode D5 for checking one directional electric current of the motor M and a high-low speed switch SW for switching the diode D5 to operation or inoperation. The neon lamp NL is effected with half wave conduction, since it is checked in the one directional current by a diode D6. During operation of the sewing machine, the voltage falling of the variable resistor VR by the current via the diode D5 or the current passing in the same direction as said current via the switch SW, is below the voltage of starting the discharge of the neon lamp NL, and the lighting indication is not made.

Figure 9:
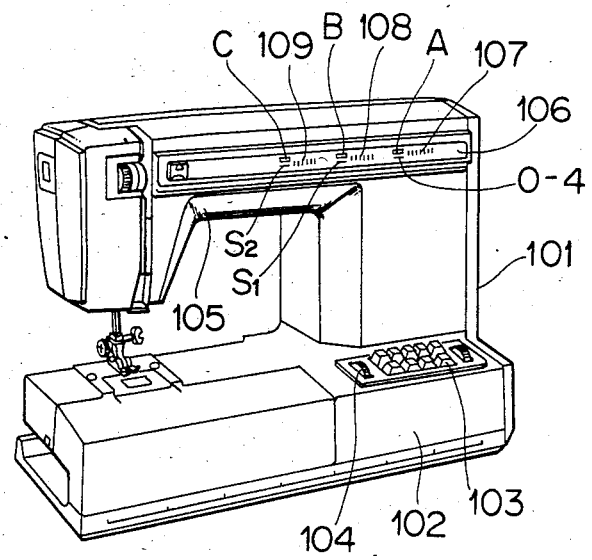
FIG. 9 is a perspective view of the sewing machine.

FIG. 9 and the following figures show a further embodiment of the invention. Explanation will be made in reference to FIGS. 9 to 13. In FIG. 9, there is disposed a feed dial 104 together with pattern selecting buttons 103 on a bed 102 of a machine body 101. The pattern selecting buttons are divided in three groups with colours of green, red and orange. A decorated plate 106 attached to an arm 105 is provided with lighting indicators A, B, C. In accordance with the operation of the feed dial 104, the ordinary feed stitch, the 1st super feed stitch and the 2nd super feed stitch are indicated with the colours of green, red orange. The lower parts of the indicators are marked with 0–4, S1 and S2, respectively. Each of shapes of patterns which are determined by combining operation of the respective pattern selecting button 103 and operation of the feed dial 104, is marked in a pattern indicating part 107, 108 or 109 according to the lighting indicators A, B, C.

Figure 10:
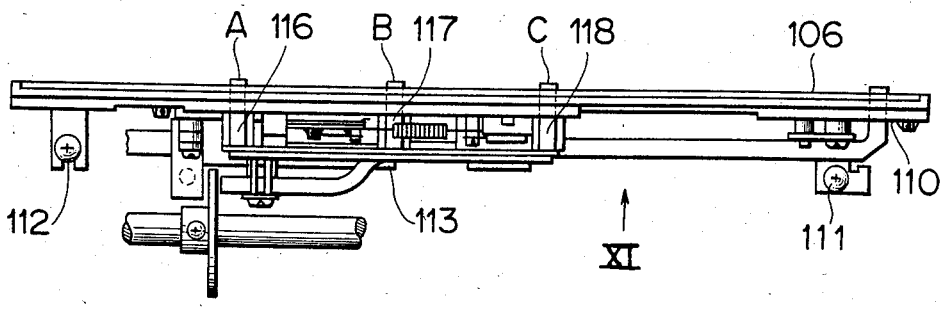
FIG. 10 is a detailed view of the decorated plate shown in FIG. 9.
Figure 11:
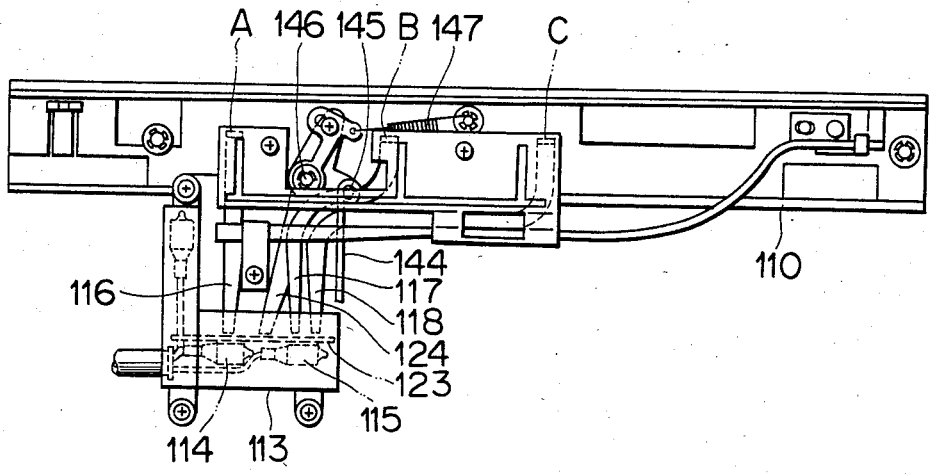
FIG. 11 is a view seen from arrow XI in FIG. 10.
Figure 12:
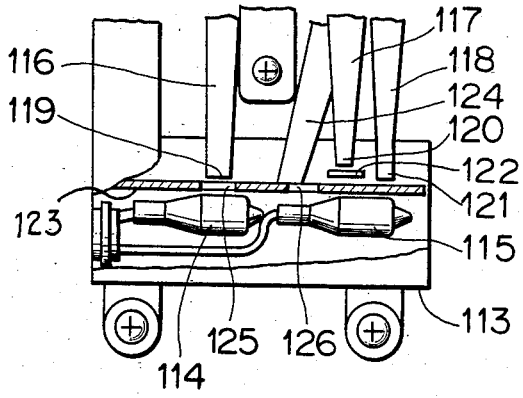
FIG. 12 is an enlarged partial cross sectional view shown in FIG. 11.
Figure 13:
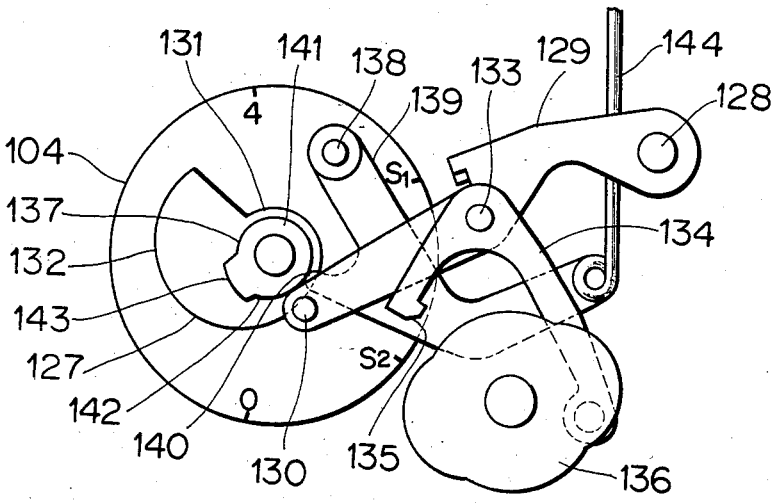
FIG. 13 is a schematic structural view of a feed dial.

With reference to FIGS. 10–12 it is seen that a decorated plate frame 110 is attached to an arm 105 by means of screws 111, 112, and is provided with a decorated plate 106 as shown in FIG. 9 on its front face. A neon tube case 113 fixed to the decorated plate frame 110 is furnished with a slow lamp 114 lighting in green and a neon lamp 115 lighting in orange which are light sources. As shown in FIG. 12, ends 119, 120, 121 of the photo-conductors 116, 117, 118 moulded of methacryl resin are positioned such that they face the slow lamp 114 and the neon lamp 115, and light is transmitted to the other sides A, B, C of the photoconductors for the light indication. A filter 122 is positioned between the neon lamp 115 and the side end of the light receiving end 120 to make the passing light red. An interrupting plate 123 is positioned between the lamps 114, 115 and the ends 119, 120, 121 of the photoconductors, and is moved by a lever 124 laterally in FIG. 12. The interrupting plate 123 is defined with holes 125, 126 for passing the light therethrough, and when the lever 124 is moved, one positioning is selected on any one of the ends 119, 120, 121 of the photoconductors. The lever 124 is turned in accordance with the operation of the feed dial 104 and an associating mechanism thereof shown in FIG. 13. The feed dial 104 is marked with 0–4, S1 and S2 on its circumference as shown, and when the mark is met with an indicating line (not shown), the feed selection or the feeding amount is adjusted. The indicating letters 0–4 indicate the ordinary feed stitch and the adjusting value of the feeding amount, and the indicating letters S1, S2 indicate the 1st and 2nd super feed stitches. The feed dial 104 is provided with a feed selecting cam face 127, and a follower pin 130 of a feed follower holder 129 which turns around a fulcrum of a pin 128 implanted on the machine body 101, follows said cam face. When the indicating letters 0–4 are at the indicating line, the follower pin 130 is against a small diameter part 131 of said cam face as shown, and when the indicating letters S1, S2 are at the indicating line, the follower pin 130 is against a large diameter part 132. A pin 133 of a feed follower holder 129 is pivoted with a follower 134, and when a pawl 135 of the follower 134 is at the smaller track of cam 136, the follower 134 is released from a super feed cam 136 as shown, and when it is at the large cam track of cam 136, the follower 134 is engaged therewith. At said releasing time, the other ordinary feed cam is selected and the ordinary feeding amount is controlled. The feed dial 104 is provided with an interruption selecting cam face 137, and a pawl 140 of an interruption selecting follower 139 which turns around a fulcrum of a pin 138 implanted on the machine body 101, follows the cam face 137. When the indicating letter 0–4 are at the indicating line, the pawl 140 is at the small diameter part 141 of cam face 137, and when the indicating letter S1 is at the indicating line, it is at a middle diameter part 142 of cam face 137 when the letter S2 is at the indicating line pawl 140 is at the large diameter part 143 of cam face 137. When the pawl 140 is at the small diameter part 141 as shown, a connecting bar 144 pivoted to the follower 139 is moved downwardly as seen in FIG. 13, and when it is at the large diameter part 143, the bar 144 is moved upwardly, and wen it is at the middle diameter part 142, the bar 144 is moved to the middle position, and in such a manner the interrupting plate 123 is moved as later mentioned. Although not shown, the super feeding cam 136 is connected to the upper drive shaft to be rotated therewith and has two cam faces for carrying out the 1st and 2nd super feed stitches. The pawl 135 of the follower 134 is selected for any one of the cam faces and follows it. When the pawl 140 of the follower 139 is at any one of the middle diameter part 142 or the large diameter part 143 of the cam face 137, the super feeding cam 136 is moved by a non-shown suitable means to the direction of the rotating shaft in order to indicate the 1st or 2nd super feed stitches. The extending part of the connecting bar 144 is shown in FIG. 11; the end of bar 144 is pivoted to the lever 124 actuating the plate 123. The lever 124 is pivoted to a pin 146 and is biased by a spring 147 in the clockwise direction in FIG. 11 to urge the pawl 140 of the follower 139 to the cam face 137. When the feed dial 104 selects the indications 0–4 and is at the ordinary feed stitching, the lever 124 moves the interrupting plate 123 to the leftmost position in FIG. 12 so that the hole 125 faces the end 119 of the photoconductor 116, and the lever 124 moves in succession the interrupting plate 123 to the rightward according to marks S1, S2 to make the hole 126 face the ends 120, 121 of the photo-conductors 117, 118.

In the above mentioned disclosure, FIGS. 11 to 13 show that the indicating letters 0–4 meet the indicating line (not shown) for selecting the ordinary feed stitching. At this time, the follower pin 130 of the feeding follower holder 129 is at the small diameter part 131 of the cam face 127, and the feed follower 134 is released from the super feeding cam 136 and the ordinary feeding cam (not shown) is selected for the ordinary feed stitching and the feed adjustment. The pawl 140 of the interruption selecting follower 139 is at the small diameter part 141 of the cam face 137 and moves the connecting bar 144 downwardly and rotate the lever 124 in the clockwise direction. The interrupting plate 123 moves to the leftmost position in FIG. 12, and the hole 125 faces the end 119 of the photoconductor 116. The lamp 114 lights in green the indicating part A. Thus, the operator may distinguish that the pattern indicated on the pattern indicator 107 is selected among the three pattern shapes indicated on the pattern selecting buttons 103.

When the operator selects the different pattern in the same ordinary feed stitchings, a desired pattern is selected from the pattern indicator 107 belonging to the present green indicator A, and the button marked with said pattern is selected from the pattern selecting buttons 103. When selecting a further pattern, a required pattern is selected from the pattern selecting buttons 103, and said pattern is found in the pattern indicators 107, 108, 109, and it is checked with the indications 0–4, S1, S2 under the indicators A, B, C belonging to said pattern.

When the feeding dial 104 is operated under a condition that the ordinary stitching is selected, and the indicating letter S1 is met to the indicating line to select the 1st super feeding stitch, the follower pin 130 of the feeding follower holder 129 is positioned at the large diameter part 132 of the cam face 127, and the pawl 135 of the feeding follower 134 is engaged with the super feeding cam 136. Thus the desired pattern is selected. The pawl 140 of the interruption selecting follower 139 is positioned at the middle diameter part 142 of the cam face 137 and moves the connecting bar 144 to the middle position upwardly, and rotates the lever 124 in the counterclockwise direction so that the interrupting plate 123 is moved to the right in FIG. 12, and the hole 126 faces the end 120 of the photoconductor 117 to indicate the indicator B in orange.

What is claimed is:

1. A needle position indicating device for a sewing machine having an upper drive shaft rotated to vertically reciprocate a needle bar having a needle attached to the lower end thereof, an electric motor operatively connected to the upper drive shaft to rotate the latter, and an electric circuit including at least a power supply and a manually operated controller operated in one way to connect said motor to said power supply to energize the former and operated in another way to disconnect said motor from said power supply to deenergize the former, said needle position indicating device comprising indicating means (NL) electrically connected to said electric circuit, said indicating means being formed such as to prevent a voltage of said power supply from causing said indicating means to emit light when said controller is operated in said one way to connect said motor to said power supply, said indicating means being free to emit light with a supply of a sufficient voltage from said power supply when said controller is operated in said another way to disconnect said motor from said power supply; and shield means (2 or 10) operated in association with said upper drive shaft so as to expose said indicating means at a predetermined angular position of said upper drive shaft when said motor is disconnected from said power supply; said predetermined angular position of said drive shaft corresponding to a predetermined position of the needle so that the position of the needle is indicated when said indicating means is exposed.

2. The needle position indicating device as defined in claim 1, wherein said indicating means is a neon lamp, and said shield means including a cylindrical element secured to said upper drive shaft for rotation therewith, said cylindrical element having a cut-out formed therein for exposing said neon lamp to the operator of the sewing machine at the predetermined angular position of the upper drive shaft.

3. The needle position indicating device as defined in claim 1, wherein said shield means is a disk secured to said upper drive shaft for rotation therewith, said disk having a cut-out for passing the light of said indicating means at the predetermined angular position thereof, and further comprising a photoconductor having one end arranged adjacent said disk and another end arranged so as to be exposed to the operator of the sewing machine.

* * * * *